US006407624B2

(12) United States Patent
Barou et al.

(10) Patent No.: US 6,407,624 B2
(45) Date of Patent: Jun. 18, 2002

(54) CIRCUIT FOR PROVIDING A REFERENCE VOLTAGE

(75) Inventors: Michel Barou, Voreppe; Marius Reffay, Grenoble, both of (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/808,733

(22) Filed: Mar. 14, 2001

(30) Foreign Application Priority Data

Mar. 15, 2000 (FR) ..... 00 03320

(51) Int. Cl.[7] ..... G05F 3/02
(52) U.S. Cl. ..... 327/542; 327/538
(58) Field of Search ..... 327/542, 538, 327/539; 323/313, 314, 315

(56) References Cited

U.S. PATENT DOCUMENTS 4,859,963 A 8/1989 Schaffer ..... 330/253
5,576,616 A * 11/1996 Ridgers ..... 323/314
5,955,874 A * 9/1999 Zhou et al. ..... 323/315
6,285,244 B1 * 9/2001 Goldberg ..... 327/539

FOREIGN PATENT DOCUMENTS

EP 0 440 434 A2 8/1991
FR 2 781 317 1/2000

* cited by examiner

*Primary Examiner*—Tuan T. Lam
*Assistant Examiner*—Hiep Nguyen
(74) *Attorney, Agent, or Firm*—Lisa K. Jorgenson; E. Russell Tarleton; Seed IP Law Group PLLC

(57) ABSTRACT

A circuit for providing a reference voltage, including a first transistor of bipolar type, the emitter of which provides the reference voltage and the collector of which is connected to a first supply pole, a second MOS-type transistor, the drain of which is connected to the base of the first transistor and the source of which is connected to a second supply pole, a control block, an output of which is connected to the gate of the second transistor and an input of which is connected to the emitter of the first transistor, a capacitor connected to the output of the control block and coupled to the first supply pole via a first impedance, and a second impedance connected on the one hand to the second transistor and on the other hand to the connection point between the capacitor and the first impedance.

14 Claims, 3 Drawing Sheets

CIRCUIT FOR PROVIDING A REFERENCE VOLTAGE

TECHNICAL FIELD

The present invention generally relates to circuits for providing a reference voltage, and in particular to a circuit for providing a stable reference voltage despite abrupt supply voltage variations, and especially, but not limited to, as applied to video amplifiers supplying a cathode-ray tube.

BACKGROUND OF THE INVENTION

FIG. 1 shows a video amplifier 2 including an operational amplifier 4, the positive terminal of which receives a reference voltage $V_{REF}$ generated by a circuit 6. The output of amplifier 4 is coupled with its negative terminal via a resistor 8 (R2). The negative terminal also receives a video signal $V_{IN}$ via a resistor 10 (R1). Amplifier 4 generates a voltage $V_{OUT}$ intended for controlling the cathode of a cathode-ray tube which may be represented by a capacitive load 12 (C). Amplifier 4 further has two supply poles respectively connected to ground and to a positive supply voltage $V_{ALIM}$. Circuit 6, which is here used to establish a reference for the black level, is also supplied by voltage $V_{ALIM}$, although this has not been shown for clarity reasons.

Circuit 6 is provided for compensating the variations of supply voltage $V_{ALIM}$. In some applications, these variations, for example due to a temperature change, are slow and circuit 6 is designed to avoid passing them on to reference voltage $V_{REF}$. In some applications, however, supply voltage $V_{ALIM}$ can abruptly vary, for example due to a current consumption peak, and this abrupt supply voltage variation can translate as a momentaneous variation of the reference voltage.

FIG. 2 illustrates an example of such a malfunction in the context of the video amplifier of FIG. 1. In FIG. 2, input signal $V_{IN}$ is at a constant level before a time t0, then undergoes a series of fast variations of large amplitude. Such variations may correspond, in the illustrated example, to the display of a series of narrow vertical stripes on the screen, alternately white and black. Output voltage $V_{OUT}$, which reproduces after amplification the inverse of signal $V_{IN}$, also varies rapidly, which, due to the relatively low impedance of load C, compels the power supply source to provide a strong current from time t0. Supply voltage $V_{ALIM}$ accordingly varies by a value $\Delta V_{ALIM}$ (which is positive in the example shown). This voltage variation is too fast to be immediately compensated by circuit 6, and voltage $V_{REF}$ varies, as will be seen hereafter, by a value $\Delta V_{REF}$ which depends on value $\Delta V_{ALIM}$. Since the voltage received on the positive terminal of amplifier 4 has varied by $\Delta V_{REF}$, signal $V_{OUT}$, which used to be equal to $-K(V_{IN}+V_{REF})+V_{REF}$, becomes:

$$V_{OUT}=-K(V_{IN}+V_{REF}+\Delta V_{REF})+V_{REF}+\Delta V_{REF},$$

where K (equal to R2/R1) is the gain of circuit 2.

At a time t1 that depends on value $\Delta V_{REF}$ and on the faculty of "recovery" of circuit 6, voltage $V_{REF}$ takes its nominal value again and signal $V_{OUT}$ once again becomes $$V_{OUT}=-K(V_{IN}+V_{REF})+V_{REF}.$$

At a time t2, signal $V_{IN}$ becomes stable again, the current surges stop on the supply source, voltage $V_{ALIM}$ increases by $\Delta V_{ALIM}$ and takes its initial value again. Voltage $V_{REF}$ increases by value $\Delta V_{REF}$ at time t2 and signal $V_{OUT}$ then becomes equal to:

$$-K(V_{IN}+V_{REF}+\Delta V_{REF})+V_{REF}+\Delta V_{REF}.$$

A little later, at a time t3, voltage $V_{REF}$ takes its nominal value again and output signal $V_{OUT}$ once again becomes $-K(V_{IN}+V_{REF})+V_{REF}$.

These variations of reference voltage $V_{REF}$ are very disturbing. In the illustrated example, the deformation of signal $V_{OUT}$ which occurs between times t2 and t3 causes a particularly unsightly light streak.

SUMMARY OF THE INVENTION

Accordingly, the disclosed embodiments of the present invention provides a circuit that generates a particularly stable reference voltage.

The embodiments of the present invention also provide such a circuit that is easy to make in the form of an integrated circuit.

To achieve the foregoing features and advantages, as well as others, the disclosed embodiments of the present invention provide a circuit for generating a reference voltage, including a first transistor of bipolar type, the emitter of which provides the reference voltage and the collector of which is connected to a first supply pole, a second MOS-type transistor, the drain of which is connected to the base of the first transistor and the source of which is connected to a second supply pole, a control block, an output of which is connected to the gate of the second transistor and an input of which is connected to the emitter of the first transistor, a capacitor connected to the output of the control block and coupled to the first supply pole via a first impedance, and a second impedance connected on the one hand to the second transistor and on the other hand to the connection point between the capacitor and the first impedance.

According to an embodiment of the present invention, the second impedance is a first resistor.

According to an embodiment of the present invention, the second impedance corresponds to the transconductance of a third diode-mounted MOS type transistor.

According to another embodiment of the present invention, the control block includes fourth and fifth bipolar transistors, of the type of the first transistor, the bases of which area interconnected, their respective collectors being connected to a first and a second current sources, the fourth transistor, which is diode-mounted, being smaller than the fifth transistor, and the output of the control block corresponding to the collector of the fifth transistor, a sixth bipolar transistor, of a different type than the first transistor, which is diode-connected and arranged between the emitter of the fourth transistor and the second supply pole, a seventh bipolar transistor, of a different type than the first transistor, arranged between the emitter of the fifth transistor and the second supply pole, the base of which is coupled to the second supply pole via a second resistor, an eighth bipolar transistor, of the same type as the first transistor, the emitter of which is coupled to the base of the seventh transistor via a third resistor, the collector of which is connected to the first supply pole, and the base of which is coupled to the second supply pole via a fourth resistor and to the input of the control block via a fifth resistor.

According to a further embodiment of the present invention, the first and second current sources are respectively ninth and tenth bipolar transistors of a different type than the first transistor, the respective emitters of which are coupled to the first supply pole via sixth and seventh resistors, the respective collectors of the ninth and tenth transistors being connected to the collectors of the fourth and fifth transistors, and their respective bases being connected to form a current mirror with an eleventh transistor of the same type, which is diode mounted and which is coupled to the first and second supply poles respectively via eighth and ninth resistors.

According to yet another embodiment of the present invention, the MOS-type transistors are NMOS transistors, the first transistor is of type NPN, and the first and second supply poles respectively represent a positive potential and the ground.

The present invention also provides an integrated circuit including such a circuit for providing a reference voltage.

The foregoing features and advantages of the present invention will be discussed in detail in the following non-limiting description of specific embodiments in connection with the accompanying drawings.

DETAILED DESCRIPTION OF THE INVENTION

For consistency and convenience, the same reference numbers designate the same elements in FIGS. 3 to 6. Only those elements necessary to the understanding of the present invention have been shown.

Figure 1:
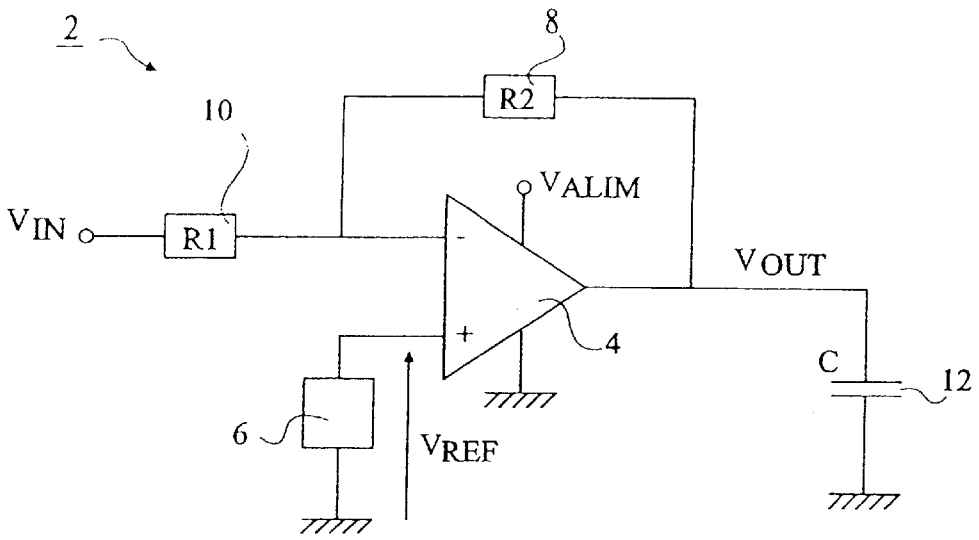
FIG. 1, previously described, shows the diagram of a video amplifier including a circuit providing a reference voltage.
Figure 2:
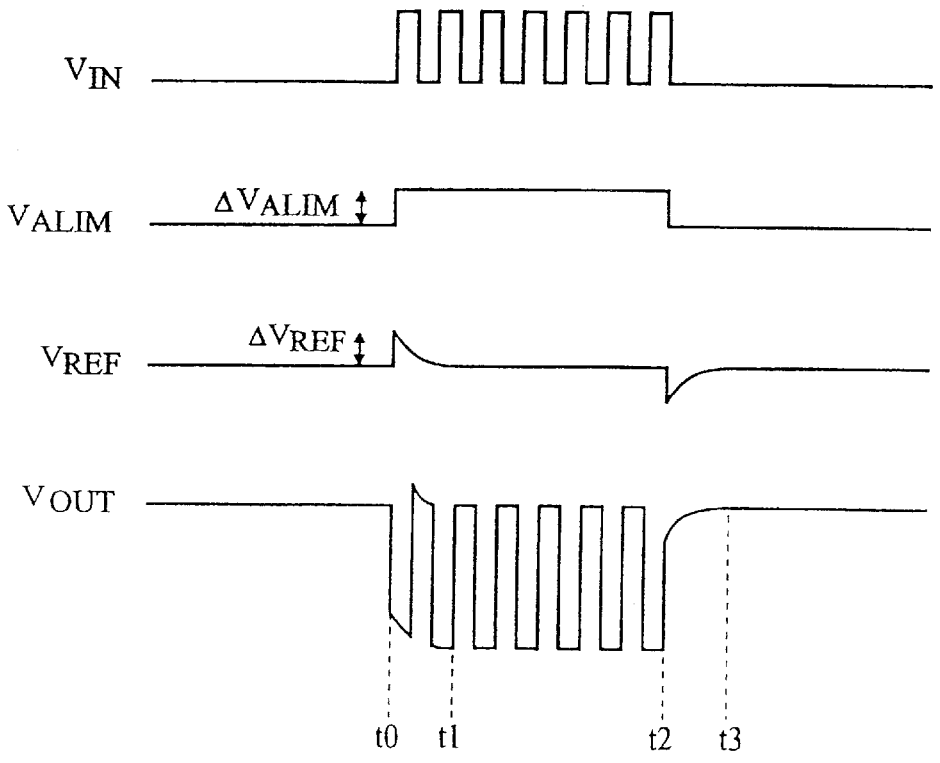
FIG. 2, previously described, illustrates an example of operation of the video amplifier of FIG. 1.
Figure 3:
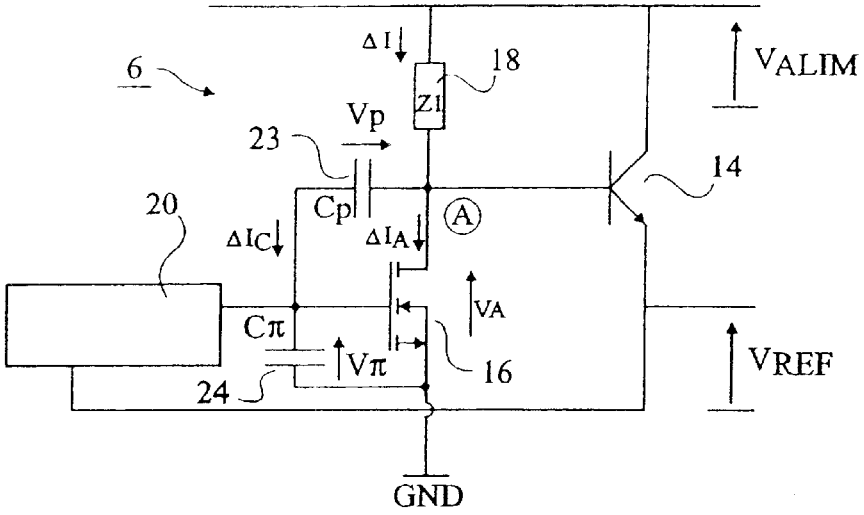
FIG. 3 shows the diagram of a circuit providing a reference voltage.

FIG. 3 shows a circuit 6 having the above disadvantages. The illustrated circuit 6 provides a reference voltage $V_{REF}$ from a supply voltage $V_{ALIM}$ and includes an NPN-type bipolar transistor 14, the collector of which receives voltage $V_{ALIM}$ and the emitter of which provides voltage $V_{REF}$. An N-type MOS transistor 16 has its drain connected on the one hand to the base of transistor 14 and on the other hand to voltage $V_{ALIM}$ via an impedance 18 (Z1). The source of transistor 16 is connected to ground (GND). A control block 20 is connected between the gate of transistor 16 and the emitter of transistor 14. Control block 20 is provided to control transistor 16 to compensate the variations of voltage $V_{REF}$. A capacitor 23 ($C_p$) connects the drain and the gate of transistor 16. A capacitor 24 ($C_\pi$), which is of low value and which represents the stray capacitance between the source and the gate of transistor 16 has also been shown. In the following description, the connection point between the drain of transistor 16 and the base of transistor 14 is called A. For simplicity, it is assumed that the gain of transistor 14 is equal to 1 (so-called "follower" or "common collector" assembly), so that a variation $\Delta V_A$ of voltage $V_A$ at node A is equal to variation $\Delta V_{REF}$ of voltage $V_{REF}$.

Calling $\Delta I$ the current variation in impedance 18 caused by a variation $\Delta V_{ALIM}$ of the supply voltage, voltage variation $\Delta V_A$ is equal to $\Delta I^* Z_A$, where $Z_A$ represents the general impedance present between node A and the ground. Calling $\Delta I_C$ the current running through capacitor $C_p$ and $\Delta I_A$ the current variation through transistor 16, one has $\Delta I=\Delta I_C+\Delta I_A$, neglecting the current in the base of transistor 14. On the other hand, considering that the entire crossing current $C_p$ totally runs into $C_\pi$, and calling $\Delta V_p$ and $\Delta V_\pi$ the variations of voltages $V_p$ and $V_\pi$ across capacitors $C_p$ and $C_\pi$, and in case of small variations which can be assimilated to differentials, one has:

$$\Delta I_C=C_p{}^*\Delta V_p=C_\pi{}^*\Delta V_\pi.$$

Further, gm being the transconductance of transistor 16, one has $\Delta I_A=gm^*\Delta V_\pi$, $\Delta V_\pi$ also representing the voltage between the gate and the source of this transistor. Further, $\Delta V_p+\Delta V_\pi=\Delta V_A$. Impedance $Z_A$ is equal to $\Delta V_A/\Delta I$, that is, $(\Delta V_p+\Delta V_\pi)/(\Delta I_C+\Delta I_A)$. Thus, the preceding formulas provide the following expression:

$$Z_A=(\Delta V_p+\Delta V_\pi)/(C_\pi\Delta V_\pi+gm^*\Delta V_\pi).$$

The preceding formulas also leads to $\Delta V_p$ being equal to $C_\pi/C_p{}^*\Delta V_\pi$. Thus:

$$Z_A=(C_\pi/C_p+1)/(C_\pi+gm).$$

Since $C_\pi$ generally has a low value as compared to gm, the preceding formula becomes:

$$Z_A=(C_\pi/C_p+1)/gm.$$

For a given variation $\Delta I$, variation $\Delta V_A$ thus is $\Delta V_A=[(C_\pi/C_p+1)gm]^*\Delta I$, which causes the previously-described undesirable variation of voltage $V_{REF}$. The present invention aims at solving this problem.

Figure 4:
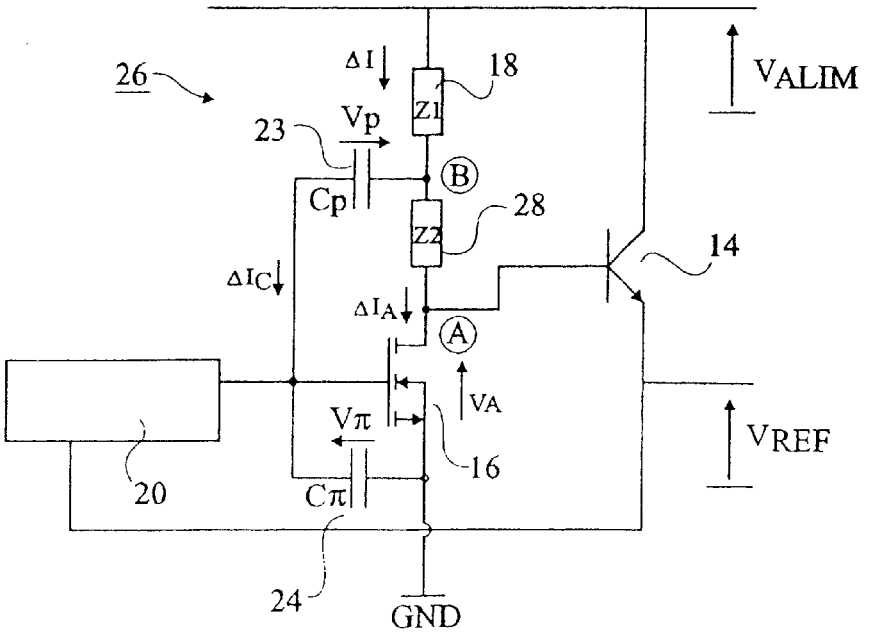
FIG. 4 schematically shows a first embodiment of a circuit providing a reference voltage according to the present invention.

FIG. 4 shows a first embodiment of a circuit 26 according to the present invention. Circuit 26 provides a reference voltage $V_{REF}$ and receives a supply voltage $V_{ALIM}$. The structure of circuit 26 is substantially the same as that of the circuit of FIG. 3, but it is structured so that the variations of voltage $V_A$ at node A do not reflect on output voltage $V_{REF}$. For this purpose, an impedance 28 of value $Z_2$ has been imposed between connection node A and connection node B, which is the connection node between impedance 18 ($Z_1$) and capacitor 23 ($C_p$).

With the preceding notations, $\Delta I=\Delta I_C+\Delta I_A$ is always true, with $\Delta I_C=C_p{}^*\Delta V_p=C_\pi{}^*\Delta V_\pi=C_\pi.\Delta I_A/gm$. In the circuit of the present invention, however, current $\Delta I_A$ now runs through impedance 28 and transistor 16, whereby $\Delta V_A=\Delta V_p+\Delta V_\pi-Z_2{}^*\Delta I_A$.

As a result:

$$\begin{aligned}\Delta V_A &= \Delta I_C/C_p+\Delta I_C/C_\pi-Z_2\cdot\Delta I_A\\ &= \Delta I_A*[C_\pi/gm*(1/C_p+1/C_\pi)-Z_2]\\ &= \Delta I_A*[(1/gm)*(C_\pi/C_p+1)-Z_2]\end{aligned}$$

If impedance 28 ($Z_2$) is chosen so that $Z_2$ is substantially equal to $1/gm^*(1+C_\pi/C_p)$, voltage variation $\Delta V_A$ due to current variation $\Delta I$ and variation $\Delta V_{REF}$ of reference voltage $V_{REF}$ are substantially null, and the present invention enables forming a circuit that provides a reference voltage that practically does not vary when $V_{ALIM}$ abruptly varies.

In an embodiment, impedance 28 is formed by one resistor only. Values gm, $C_\pi$, and $C_p$ can be precisely determined and such a resistor is easily formed. This embodiment is particularly simple to implement and provides a clear improvement with respect to prior art. However, it does not enable perfect canceling of $\Delta V_{REF}$.

Indeed, the value of the resistor forming impedance 28 must be proportional to the inverse of the transconductance of transistor 16 and the values of these elements do not evolve in the same way with temperature. Further, if the circuit of the present invention is made in integrated form, the resistors and transistors are not produced during the same steps and technological dispersions may cause a drift of the value of the resistor with respect to that of the transconductance of transistor 16.

Figure 5:
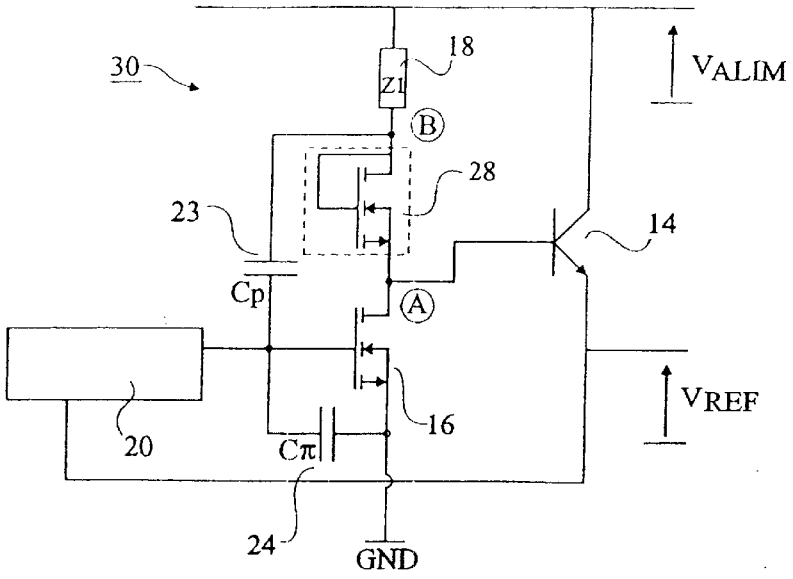
FIG. 5 schematically shows a second embodiment of a circuit providing a reference voltage according to the present invention.

FIG. 5 shows a circuit 30 according to a second embodiment of the present invention, which enables obtaining a substantially null variation $\Delta V_{REF}$, independently from the dispersions due to the manufacturing, even in the case of an implementation in integrated form. In this embodiment, impedance 28 is formed by means of a diode-mounted MOS transistor of same type as transistor 16. Transistor 28 is calculated to have a transconductance gm' such that $1/gm^*(1+C_\pi/C_p)=1/gm'$. For example, if transistors 28 and 16 having channels of same length and of widths W and W', respectively, are used, the preceding relation will be obtained with:

$$\sqrt{W/W'}=(1+C\pi/Cp).$$

Transistors 28 and 16 are manufactured at the same time and modifications of their characteristics due to possible technological dispersions will be identical. Thus, in this embodiment, voltage $V_{REF}$ will remain very stable even if voltage $V_{ALIM}$ abruptly varies.

As it has been seen, the preceding formulas have been obtained by means of approximations, whereby the canceling of $\Delta V_{REF}$ will not be rigorously null in practice. If desired, a thorough calculation and an exact determination of impedance 28 are within the abilities of those skilled in the art.

Figure 6:
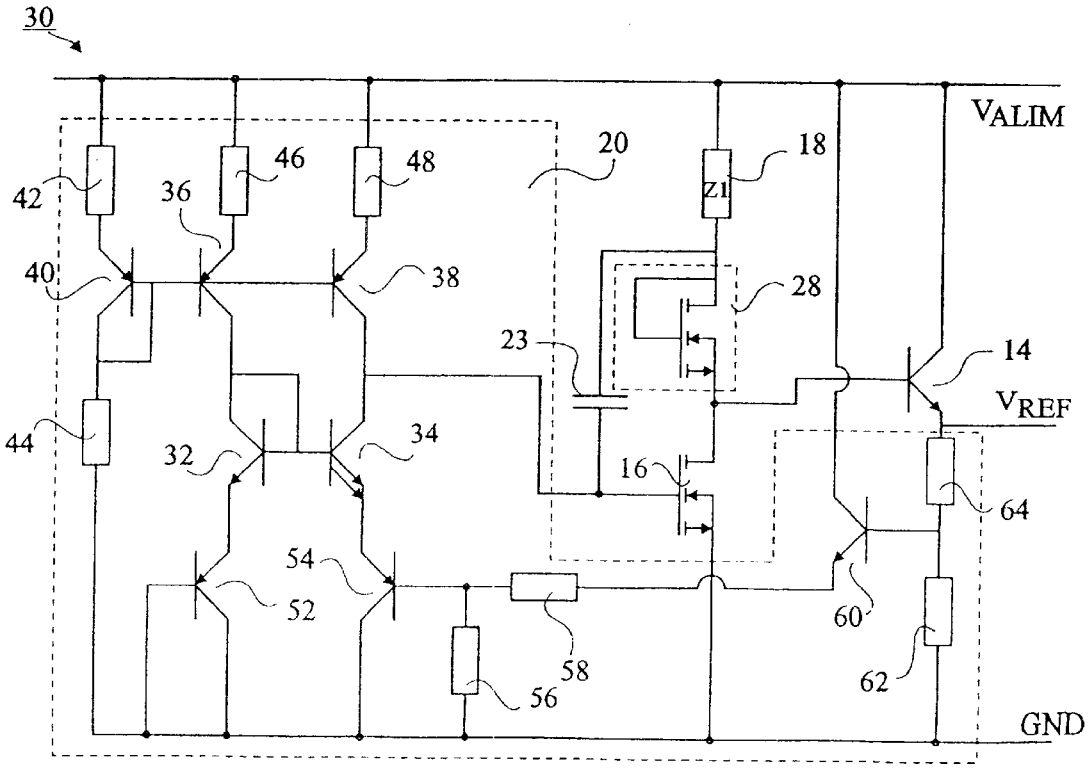
FIG. 6 shows in further detail an electric diagram of the circuit of FIG. 5.

FIG. 6 illustrates in further detail an embodiment of circuit 30 of FIG. 5. For clarity, stray capacitance $C_\pi$ of transistor 16 has not been shown. Control block 20 includes two NPN-type bipolar transistors 32 and 34, the bases of which are interconnected. Transistor 32 is diode-connected and transistor 34 has a greater emitter than transistor 32. The collectors of transistors 32 and 34 are respectively connected to the collectors of two bipolar PNP-type transistors 36 and 38. Transistors 36 and 38, of identical size, have their bases connected to the base of a transistor 40 of same type and of same size, diode-connected and coupled between the supply voltage and the ground via resistors 42 and 44, respectively. The emitters of transistors 36 and 38 are coupled to the supply voltage respectively by resistors 46 and 48. The emitters of transistors 32 and 34 are respectively connected to the emitters of two PNP-type bipolar transistors 52 and 54. The collectors of transistors 52 and 54 are grounded. The base of transistor 52 is grounded. The base of transistor 54 is coupled to the ground via a resistor 56, and coupled to the emitter of a bipolar NPN-type transistor 60 via a resistor 58. The collector of transistor 60 is connected to the supply voltage. Its base receives a fraction of voltage $V_{REF}$ obtained by means of a dividing bridge formed by a resistor 62 and a resistor 64, respectively connected to the ground and to the emitter of transistor 14. The junction point of resistor 64 and of the emitter of transistor 14 corresponds to the input of control block 20. The structure and operation of control block 20 are known by those skilled in the art and they will not be described any further. Circuit 30 may be built with components of standard size and type, and it can easily be made in integrated form.

In the circuit of FIG. 30, impedance 28 is formed by a diode-mounted transistor. However, adapting the circuit of FIG. 6 to the first embodiment, in which an appropriate resistor replaces transistor 28, is part of the present invention.

The present invention thus enables forming a circuit generating a reference voltage that does not vary, even in the case of an abrupt variation. The circuit according to the present invention is of reduced size and easy to make in integrated form.

Of course, the present invention may have various alterations, modifications, and improvements which will readily occur to those skilled in the art.

In particular, circuits that provide a positive reference voltage have been described, but those skilled in the art will easily adapt the present invention to a circuit providing a negative voltage, among others by replacing the NMOS transistor with PMOS transistors and by inverting the type of the bipolar transistors.

Similarly, the circuit supply pole called GND does not necessarily represent the ground and reference voltage $V_{REF}$ may be unconnected to ground and thus be "floating" with respect thereto.

Also, only two examples of embodiment of impedance $Z_2$ have been described. The present invention is not limited to these examples of embodiment only and those skilled in the art will easily determine other appropriate types of impedance.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for providing a reference voltage, comprising:

a first transistor of bipolar type, the emitter of which provides the reference voltage and the collector of which is connected to a first supply pole, a first MOS-type transistor, the drain of which is connected to a base of the first transistor and the source of which is connected to a second supply pole, a control block, an output of which is connected to a gate of first MOS-type transistor and an input of which is connected to the emitter of the first transistor, a capacitor connected to the output of the control block and coupled to the first supply pole via a first impedance, and a second impedance connected on the one hand to the drain of the first MOS-type transistor and on the other hand to the connection point between the capacitor and the first impedance.

2. The circuit of claim 1, wherein the second impedance is a first resistor.

3. The circuit of claim 1, wherein the second impedance corresponds to the transconductance of a third diode-mounted MOS type transistor.

4. The circuit of claim 3, wherein the control block includes:

fourth and fifth bipolar transistors, of the type of the first transistor, the bases of which are interconnected, their respective collectors being connected to first and second current sources, the fourth transistor, which is diode-mounted, being smaller than the fifth transistor, and the output of the control block corresponding to the collector of the fifth transistor, a sixth bipolar transistor, of a different type than the first transistor, which is diode-connected and arranged between the emitter of the fourth transistor and the second supply pole, a seventh bipolar transistor, of a different type than the first transistor, arranged between the emitter of the fifth transistor and the second supply pole, the base of which is coupled to the second supply pole via a second resistor, an eighth bipolar transistor, of the same type as the first transistor, the emitter of which is coupled to the base of the seventh transistor via a third resistor, the collector of which is connected to the first supply pole, and the base of which is coupled to the second supply pole via a fourth resistor and to the input of the control block via a fifth resistor.

5. The circuit of claim 4, comprising the first and second current sources that are respectively ninth and tenth bipolar transistors of a different type than the first transistor, the respective emitters of which are coupled to the first supply pole via sixth and seventh resistors, the respective collectors of the ninth and tenth transistors being connected to the collectors of the fourth and fifth transistors, and their respective bases being connected to form a current mirror with an eleventh transistor of the same type, which is diode mounted and which is coupled to the first and second supply poles respectively via eighth and ninth resistors.

6. The circuit of claim 5, wherein the MOS-type transistors are NMOS transistors, the first transistor is of type NPN, and the first and second supply poles respectively represent a positive potential and the ground.

7. A circuit for providing a reference voltage, comprising:

a voltage compensation circuit configured to compensate for variations in a first supply voltage received from a first supply voltage source and to generate a stable reference voltage therefrom, the compensation circuit comprising:

a first bipolar transistor having a collector coupled to the first supply voltage source, an emitter coupled to an output, and a base;

a first MOS-type transistor having a source coupled to a second supply voltage source, a drain coupled to the first supply voltage source via a first impedance and coupled to the base of the bipolar transistor, and a gate coupled to a control signal terminal; and a second impedance coupled between the first impedance and the drain of the first MOS-type transistor.

8. The circuit of claim 7, wherein the second impedance comprises a resistor element.

9. The circuit of claim 8, wherein the resistor element has a value of $1/gm*(1+C_\pi/C_p)$, where:

gm is the transconductance of the first MOS-type transistor, $C_\pi$ is the stray capacitance between the source and gate of the first MOS-type transistor, and $C_p$ is the capacitance present between the drain and the gate of the first MOS-type transistor.

10. The circuit of claim 7, wherein the second impedance comprises a second MOS-type transistor, the second MOS-type transistor diode connected.

11. The circuit of claim 10, wherein the second MOS-type transistor is configured to have a transconductance gain gm' such that $1/gm*(1+C_\pi/C_p)=1/gm'$.

12. The circuit of claim 10, wherein the first and second MOS-type transistors have channels of the same length.

13. The circuit of claim 12, wherein the first and second MOS-type transistors have widths w and w' respectively that satisfy the relation $\sqrt{W/W'}=(1+C_\pi/C_p)$.

14. The circuit of claim 11, further comprising the control circuit having an output coupled to the control signal terminal, the control circuit comprising second and third bipolar transistors of the type of the first bipolar transistor, the bases of which are interconnected, the second and third bipolar transistors having collectors connected to first and second current sources, respectively, and the second transistor diode connected and structured to be smaller than the third transistor;

a fourth bipolar transistor of a different type than the first bipolar transistor, the fourth bipolar transistor diode connected and arranged between the emitter of the third bipolar transistor and the second supply voltage source;

a fifth bipolar transistor of a different type than the first bipolar transistor and coupled between the emitter of the third bipolar transistor and the second supply voltage source, the fifth bipolar transistor having a base that is coupled to the second supply voltage source via a resistor component; and a sixth bipolar transistor of the same type as the first bipolar transistor, the sixth bipolar transistor having an emitter that is coupled to the base of the fifth bipolar transistor, a collector connected to the first supply voltage source, and a base coupled to the second supply voltage source and to an input terminal of the control circuit.

* * * * *

UNITED STATES PATENT AND TRADEMARK OFFICE

CERTIFICATE OF CORRECTION

PATENT NO. : 6,407,624 B2
DATED : June 18, 2002
INVENTOR(S) : Michel Barou et al.

It is certified that error appears in the above-identified patent and that said Letters Patent is hereby corrected as shown below:

Column 8,
Lines 23 and 24, “the control circuit” should read as -- a control circuit --.
Lines 24 and 25, “the control signal terminal,” should read as -- a control signal terminal, --.

Signed and Sealed this

Twenty-ninth Day of October, 2002

*Attest:*

*Attesting Officer*

JAMES E. ROGAN
*Director of the United States Patent and Trademark Office*